US005913265A

United States Patent [19]

Ishii et al.

[11] Patent Number: 5,913,265

[45] Date of Patent: Jun. 22, 1999

[54] STENCIL PRINTING DRUM, WITH OPENING TO ALLOW INK RETURN TO INSIDE OF DRUM

[75] Inventors: Shigenori Ishii; Katsuro Motoe, both of Ibaraki-ken, Japan

[73] Assignee: Riso Kagaku Corporation, Tokyo, Japan

[21] Appl. No.: 09/106,282

[22] Filed: Jun. 29, 1998

[30] Foreign Application Priority Data

Jul. 2, 1997 [JP] Japan ..... 9-177179

[51] Int. Cl.[6] ..... B41L 13/06

[52] U.S. Cl. ..... 101/120; 101/116

[58] Field of Search ..... 101/116, 118, 101/119, 120, 128.1

[56] References Cited

U.S. PATENT DOCUMENTS

| | | | |
|---|---|---|---|
| 5,255,599 | 10/1993 | Kobayasi et al. | 101/116 |
| 5,483,878 | 1/1996 | Hanzawa | 101/118 |
| 5,617,786 | 4/1997 | Negishi | 101/120 |
| 5,673,620 | 10/1997 | Negishi et al. | 101/120 |

FOREIGN PATENT DOCUMENTS

| | | |
|---|---|---|
| 0 672 535 | 9/1995 | European Pat. Off. . |
| 0 697 289 | 2/1996 | European Pat. Off. . |
| 0 739 752 | 10/1996 | European Pat. Off. . |

*Primary Examiner*—Edgar Burr
*Assistant Examiner*—Leslie Grohusky
*Attorney, Agent, or Firm*—Kanesaka & Takeuchi

[57] ABSTRACT

A stencil printing drum includes a cylindrical circumferential wall which includes an ink permeable area and an ink impermeable area surrounding the ink permeable area. The wall is wrapped with a perforated stencil sheet and driven to rotate around a central axis of itself. The drum also includes an ink supply roller provided inside the wall for supplying ink to an inner surface of the wall. The roller presses ink outwardly from the ink permeable area to pass through a perforated area of the stencil sheet wrapped around the wall for printing. The drum also includes an ink impermeable projection. The projection is provided on a rear end portion of the ink permeable area in a rotating direction of the wall along one of the generatrices of the cylindrical wall. The projection projects inside the cylindrical wall, thereby dividing the ink permeable area and the ink impermeable area. The drum also includes an ink cover sheet provided on an outer surface of the cylindrical wall to cover an area ranging from the ink impermeable area to the ink impermeable projection. The ink cover sheet is fixed at a rear end portion thereof in the rotating direction of the wall. The cylindrical wall has an opening after the ink impermeable projection in the rotating direction and the opening is formed adjacent to the projection and along one of the generatrices of the cylindrical wall.

2 Claims, 9 Drawing Sheets

STENCIL PRINTING DRUM, WITH OPENING TO ALLOW INK RETURN TO INSIDE OF DRUM

BACKGROUND OF THE INVENTION

The present invention relates to an improvement in a stencil printing drum having a cylindrical circumferential wall.

FIGS. 3 through 6 show an example of a stencil printing machine, which has been proposed by the present applicant. This stencil printing machine has been disclosed in Japanese Provisional Patent Publication No. 132,671/95. In those drawings, reference numeral 1 designates a flexible rotary cylindrical printing drum. The drum 1 comprises: a pair of disk-shaped rigid side boards 3 at both ends; a rigid clamp base plate 5 which is extended axially (along the generating line of the drum) to connect the pair of side boards 3; and a screen member 9 laid cylindrical to form a cylindrical circumferential wall 7 with the right and left edges supported by the side boards 3. The screen member 9 is a net formed by weaving wires such as stainless wires. Printing ink is allowed to pass through the meshes of the net. The screen member 9 forming the cylindrical circumferential wall 7 is flexible, and therefore the wall 7 is radially deformable.

A clamp plate 11 for detachably clamping an end portion (front leading end portion) of a stencil sheet is coupled to the clamp base plate 5. A stencil sheet is set on the drum as follows: With the front leading end portion of the stencil sheet locked to the clamp base plate 5 by the clamp plate 11, the stencil sheet is wound around the cylindrical circumferential wall 7.

The drum 1 has a central cylindrical shaft 13 which is a fixed shaft extended through the drum on the axis, thus supporting the drum; that is, the drum 1 mounted on the central cylindrical shaft 13 is rotatable around its central axis. Drum driving gears 15 are formed in the outer peripheral surfaces of the pair of side boards 3, respectively. The gears 15 mesh with driving gears of a drum driving motor (not shown), so that the drum is driven to rotate counterclockwise (in FIG. 1) around the central cylindrical shaft 13.

Inside the drum 1, an inside frame 17 is fixedly provided being supported by the central cylindrical shaft 13.

The inside frame 17 supports an inside pusher arm 21 at one end through a shaft 19 in such a manner that the inside pusher arm 21 is substantially vertically swingable. The middle portion of the inside pusher arm 21 rotatably supports an ink supply roller 23. The ink supply roller 23 is extended along one of the generatrices of the cylindrical drum 1 in such a manner that it is in slide contact with the inner surface of the tubular wall 7.

The inside pusher arm 21 fixedly supports a doctor rod 25 which is extended in parallel with the ink supply roller 23 with a small gap between them. The ink supply roller 23 and the doctor roller 25 form a wedge-shaped ink pool 27 into which printing ink is regularly supplied from an ink delivery pipe 29. The ink delivery pipe 29 is connected to an ink supplying hose 31. The hose 31 is extended through the central cylindrical shaft 13, thus being exposed outside the drum and connected to an ink supplying source (not shown), to supply the printing ink to the ink pool 27.

As the ink supply roller 23 is rotated counterclockwise in the figure, the ink in the ink pool 27 is supplied to the inner cylindrical surface of the cylindrical circumferential wall 7 while being regulated by the doctor roller 25.

The inner frame 17 rotatably supports a cam shaft 33 to which a cam 35 is fixedly mounted. The cam 35 is a double-heart-shaped plate cam. The cam 35 is turned through 90° at a time, thus taking one of two stable positions, namely, a printing angular position shown in FIGS. 3 and 5, and the other stable position, namely, a non-printing angular position shown in FIGS. 5 and 6.

The cam 35 is engaged with a cam follower 39 mounted on a linkage yoke member 37. The linkage yoke member 37 is linked to the other end portion of the inside pusher arm 21 through a shaft 41.

Thus, when the cam 35 is at the printing angular position, the ink supply roller 23 is at a lower position while being in slide contact with the inner surface of the tubular wall 7; whereas when the cam is at the non-printing angular position, as shown in FIG. 4, the ink supply roller 23 is raised together with the inside pusher arm 21, thus being spaced from the inner surface of the tubular wall 7.

The cam shaft 33 is connected to the driven side of an electromagnetic clutch 43. The driving side of the clutch 43 is coupled to a cam shaft drive gear 45, so that the cam shaft drive gear 45 and the cam shaft 33 are selectively coupled to each other by the electromagnetic clutch 43. The cam shaft drive gear 45 is engaged with an inside main gear 47 which is fixedly mounted on the side plate 3 of the drum 1 so that the gear 45 is turned by the rotation of the drum 1.

A cam switch 49 made up of a limit switch is mounted on the inside frame 17. The cam switch 49 is engaged with a switch actuating piece 51 mounted on the linkage yoke member 37, to detect the position of the cam 35; i.e., to determine whether the cam 35 is at the printing angular position or at the non-printing angular position.

The central cylindrical shaft 13 rotatably supports a roller drive arm 53 at the middle. One end portion of the roller drive arm 53 rotatably supports an intermediate gear 55. The other end portion of the roller drive arm 53 is connected to a tension spring 57 so that the arm 53 is urged counterclockwise in FIG. 3 by the elastic force of the tension spring 57. As a result, the intermediate gear 55 is engaged with the inside main gear 47 and with a gear 58 that is mounted on the end of the ink supply roller 23 coaxially with the roller 23. Hence, as the drum 1 rotates, the intermediate gear 55 is turned to rotate the ink supply roller 23 counterclockwise in FIG. 3.

When the ink supply roller 23 is turned counterclockwise in FIG. 3 in the above-described manner under the condition that the cam 35 is at the printing angular position, and the ink supply roller 23 is at the lower position while being in slide contact with the inner surface of the tubular wall 7, then the ink supply roller 23 is set at a deformation position (cf. FIG. 3), thus being pushed against the inner surface of the tubular wall 7 to deform the tubular wall 7 toward a lower pusher roller 63 (detailed latter).

On the other hand, when the ink supply roller 23 is turned counterclockwise in FIG. 3 under the condition that the cam 35 is at the non-printing angular position and the ink supply roller 23 is spaced from the inner surface of the tubular wall 7, the ink supply roller 23 will not deform the tubular wall 7. Hereinafter, this position of the ink supply roller 23 (cf. FIG. 4) will be referred to as "a steady position", when applicable.

As shown in FIG. 6, a cam follower 59 is mounted on the ink supply roller 23. As the drum 1 rotates, the cam follower 59 is engaged with a cam 61 that is formed in the inner surface of the drum 1. As a result, the ink supply roller 23 is raised with a rotational phase of the drum 1 corresponding to the stencil sheet clamping region of the drum 1; that is, the ink supply roller 23 is prevented from pushing the inner surface of the tubular wall 7, which prevents the production of a collision sound by the collision of the clamp base plate 5 with the corners of a recess 65 of the lower pusher roller 63 (described later), and protects the screen member 9.

The lower pusher roller 63 is equal in outside diameter to the cylindrical printing drum 1. The lower pusher roller 63 is mounted on a central shaft 62 in such a manner that it is located at a predetermined distance from the tubular wall 7, and is in parallel with the drum 1. The lower pusher roller 63 is rotated clockwise (in FIG. 3) around its own central axis in synchronization with the drum 1 by a synchronous rotation drive unit (not shown) at the same speed as the drum 1. In order to prevent the interference of the lower pusher roller 63 with the stencil paper clamping section of the drum 1, the lower pusher roller 63 has the aforementioned recess 65 in the part of its outer surface which corresponds in angular position to the stencil sheet clamping section of the drum 1.

When the tubular wall 7 is deformed depending on the positional relationship between the drum 1 and the lower pusher roller 63, then as shown in FIG. 3 the tubular wall 7 thus deformed pushes the stencil sheet wound on the drum against the printing sheet P provided on the lower pusher roller 63. Upon releasing the tubular wall 7 from the deformation as shown in FIG. 4, a gap is formed between the drum 1 and the lower pusher roller 63.

The lower pusher roller 63 has a sheet clamping member 67 which is swingably mounted on the lower pusher roller 63 through a shaft 69. The sheet clamping member 67 is provided with a clamping piece 71 at one end which cooperates with the outer surface of the lower pusher roller 63 to detachably hold the printing sheet P. The sheet clamping member 67 is further provided with a cam follower roller 73 at the other end. When the cam follower roller 73 is engaged with a cam 75 which is fixedly set, the front leading end portion of the printing sheet P, which is supplied from a sheet supplying section 77 (provided on the left in FIG. 3) in synchronization with the rotation of the lower pusher roller 63, is clamped at an angular position (sheet clamping position "a" in FIG. 4) of the lower pusher roller 63, and is released at another angular position (sheet releasing position "b" in FIG. 2).

Thus, the lower pusher roller 63 acts as a roller having a printing sheet conveying function; that is, the lower pusher roller causes the printing sheet P to be wound on its outer surface between the sheet clamping position "a" and the sheet releasing position "b" so that the printing sheet P is forcibly conveyed.

The sheet supplying section 77 includes: a sheet supplying table 81 on which printing sheets P are stacked; sheet supplying rollers 83 and a sheet separating roller 85 for taking the printing sheet P out of the sheet supplying table 81 one by one; sheet guiding member 87: a pair of timing rollers 89 for delivering the printing sheet P to the sheet clamping position "a" (where the printing sheet P is clamped by the clamping piece 71) on the lower pusher roller 63 with predetermined timing; and a sheet supplying optical sensor 91 for detecting the delivery of the printing sheet P to the sheet nipping position "a".

A sheet discharging section 79 includes: a sheet discharging pinch roller 93 which is provided at the sheet releasing position "b" and cooperates with the lower pusher roller 63 to pinch the printing sheet P to discharge the sheet P; a sheet separating claw 95 for separating the printing sheet P from the lower pusher roller 63; a pair of pinch rollers 99 for sending the printing sheet P separated by the sheet separating claw to a sheet throwing stand 97; a sheet discharging tray 101 on which the printed sheets P are stacked; and a sheet discharging optical sensor 103 for detecting the throwing of the printing sheet P from the sheet throwing stand 97 to the sheet discharging tray 101.

The sheet discharging pinch roller 93 and the upper one of the pair of sheet discharging pinch rollers 99 are brought into contact with the upper side of the printing sheet P to be discharged which is a printing surface. More specifically, those rollers are so designed that they are brought into contact with both side margins of each printing sheet P where nothing is printed. In order to bring those rollers 93 and 99 into contact with only both side margins of each printing sheet P irrespective of the width of the sheet P, the positions of those rollers 93 and 99 are automatically adjusted in the direction of axis according to the size of a printing sheet P. In this case, a sheet size sensor (not shown) which detects the size of the printing sheet P is provided on the sheet discharging tray 101.

FIG. 7 is a sectional view illustrating the flexible cylindrical circumferential wall 7, and FIG. 8 is a development of the cylindrical wall 7. In the drawings the reference numeral 8 indicates an ink impermeable end projection. FIG. 9 illustrates the ink supply roller 23. The structure of this cylindrical circumferential wall is disclosed in Japanese Patent Application No. 181,566/94 filed by the present applicant.

As illustrated in FIG. 8, the flexible cylindrical circumferential wall 7 of the drum 1 is rectangular when being developed. In approximately the center of the wall, there is provided an ink permeable area. The ink permeable area is surrounded by an ink impermeable area.

It will be recognized that there are various constitutions for the cylindrical circumferential wall 7 including the ink impermeable area and the ink permeable area surrounded by the ink impermeable area. For example, the wall may be so constituted that overlapping plural ink-permeable screens are rolled in a cylindrical form, and then rigid annular members are attached to both sides of the cylindrical form, thus constituting a wall of a cylindrical shape. In this constitution, the ink permeable area and the ink impermeable area can be formed in a desired form by optionally applying filling resin to a part of the screen in a printing method.

Instead of such constitution, the cylindrical circumferential wall also may be constituted in such a manner that a metal plate of a predetermined rigidity is perforated by an electroforming process to form the ink permeable area 2, and then the plate is rolled in a cylindrical shape. Further, such the metallic cylindrical circumferential wall may be optionally wrapped by an ink permeable screen, so that ink can be uniformly provided to a printing paper after passing through the drum and transferring to the outside thereof.

As illustrated in FIG. 8, the ink impermeable end projection 8 is formed in a boundary area between a rear-end side (hereinafter referred to as a "rear-end portion 2*a*") of the ink permeable area in a rotating direction A1 of the stencil printing drum 1 and the ink impermeable area adjacent to the rear-end portion 2*a*. The ink impermeable end projection 8 is arranged approximately parallel to the rotating axis of the stencil printing drum 1.

As illustrated in FIG. 8, two ink impermeable side projections 10, 10 are formed parallel to each other, while having the ink permeable portion 2 therebetween. The side projections are located in a boundary area between both side edges, which are parallel to the rotating direction A1 of the stencil printing drum 1, of the ink permeable area 2 and the ink impermeable area 4. The two ink impermeable side projections 10, 10 are extended to an area where the ink impermeable portion 4 is located therebetween. The ink impermeable portion 4 sandwiched by the projections 10, 10 is adjacent to a forward-end side (hereinafter referred to as a "forward-end portion 2*b*").

As illustrated in FIG. 7, the ink impermeable end projection 8 and the ink impermeable side projections 10 are protruding inwardly from the inner surface of the cylindrical circumferential wall 7 by their thickness of T. Further, inner side faces of the projections 8 and 10, which are adjacent to the ink permeable area 2, meet with the ink permeable area 2 in an angle except an obtuse angle. In the present embodiment this angle is set at a right angle. The ink impermeable end projection 8 and ink impermeable side projection 10 can be formed by applying an ink-proof material such as silicon to the inner surface of the cylindrical circumferential wall 7 in a printing method. It is desirable that the ink impermeable side projection 10 should be composed of an elastic material.

The ink supply roller 23 is disposed in the cylindrical circumferential wall 7. The roller 23 includes a rotating axis that is parallel to the rotating axis of the stencil printing drum 1. The roller presses ink outwardly through the ink permeable area 2 while being in contact with the inner surface of the stencil printing drum 1. The mechanism for vertically moving the ink supply roller 23 has been explained. This ink supply roller 23 is composed of an elastic material.

As illustrated in FIG. 9, the ink supply roller 23 comprises a roller portion 12, annular stages 14, and axes 16. The roller portion 12 is in contact with the ink permeable area 2. The annular stages 14 are disposed on both ends of the roller portion 12, and the diameter of the stage 14 is smaller than that of the roller 12. The axes 16 are coaxially disposed on both ends of the annular stages 14.

The axial length of the roller portion 12 is arranged to be slightly smaller than the distance between the pair of the ink impermeable side projections 10, 10. A half of the difference between the annular stage 14 and the roller 12 in their diameters corresponds to the thickness "t" of the ink impermeable end projection 8 and the ink impermeable side projection 10. Accordingly, when the ink supply roller 23 is in contact with the inner surface of the cylindrical circumferential wall 7 during printing, the roller 12 is contacted with the ink permeable area 2 and the annular stage 14 is contacted with an upper surface of the ink impermeable side projection 10.

When the stencil sheet 28 (not shown in FIGS. 3–6) is wrapped around the stencil printing drum 1 after being clamped at the leading end thereof by the clamp plate 11 against a clamping position of the clamp base plate 5, a perforated image area of the stencil sheet S corresponds with the ink permeable area 2. In synchronization with rotation of the stencil printing drum 1, the printing sheet P is supplied between the stencil printing drum 1 and the lower pusher roller 63, while the ink supply roller 23 moves downwardly to be in contact with the inner surface of the cylindrical circumferential wall 7. The printing sheet P is sandwiched between the cylindrical circumferential wall 7 deformed downwardly by the ink supply roller 23 and the lower pusher roller 63. Ink is, after being supplied to the inner surface of the cylindrical circumferential wall 7 by the ink supply roller 23, then moved to the outside of the wall passing through the ink permeable area and the perforated image area of the stencil sheet S, thereby transferring onto the printing sheet P.

In operation explained above, part of the ink that is supplied to the inner surface of the stencil printing drum 1 but not consumed in printing accumulates inside the ink permeable end projection 8 with rotation of the ink supply roller 23 and the stencil printing drum 1. The ink accumulated inside the ink impermeable end projection 8 is conveyed away by the ink supply roller 23, while sticking to the circumferential surface of the supply roller 23, at every time when the ink supply roller 23 moves across the ink impermeable end projection 8. Thus, ink is prevented from accumulating excessively inside the ink impermeable end projection 8; also, accumulated ink would not leak outside.

FIG. 10 is an enlarged sectional view illustrating neighborhood of the rear side of the ink permeable area 2 in the rotational direction of the cylindrical circumferential wall 7. In the drawing, the reference numeral 22 indicates a relatively coarse screen, a flexible net that is woven from wires such as stainless wires. Also, the reference numeral 24 indicates a relatively fine screen. These two screens are overlapped with each other to form the cylindrical circumferential wall 7. The cylindrical circumferential wall 7 includes the ink permeable area 2 that is not filled, and the ink impermeable area 4 that surrounds the ink permeable area 2. The ink impermeable area 4 is such that the screen is filled with silicon rubber and the filling integrates the two screens 22 and 24. Further, the reference numeral 8 indicates the ink impermeable end projection, the reference numeral 26 indicates an ink cover sheet, and the reference numeral 28 indicates a stencil sheet. The ink cover sheet 26 is a strip that is made of polyethylene terephthalate. A part of the sheet 26 that faces the ink impermeable area 4 is entirely bonded to the outer surface of the area 4.

During printing, the ink supply roller 23 presses against the inner surface of the cylindrical circumferential wall 7, and the pressing is to be finished at a position indicated by the reference 6K as illustrated in FIG. 10. The position 6K is located behind the ink impermeable end projection 8 relative to the rotating direction of the drum 1. Namely, the cam 61 as explained before with reference to FIG. 6 is formed in such an outer shape as to allow the ink supply roller 23 to move in this way.

With reference to FIG. 10, a technical problem in the stencil printing machine proposed by the present applicant will be explained. During printing in the stencil printing machine, the ink permeates through the ink permeable area 2 outwardly of the stencil printing drum 1, and is then stopped to flow toward an outer circumferential side of the ink impermeable area 4 while being dammed up by the ink cover sheet 26. However, repetition of printing gradually allows ink to penetrate into the clearance (a bonded area) between the ink cover sheet 26 and the cylindrical circumferential wall 7 as shown by the arrow D1, thereby peeling the ink cover sheet 26 partially and gradually from the cylindrical circumferential wall 7. And then, the ink between the ink cover sheet 26 and the cylindrical circumferential wall 7 advances gradually toward a rear end side of the ink cover sheet 26. The ink finally leaks from the rear end of the ink cover sheet 26 as shown by the arrow D2. This behavior of the ink may spoil the outer circumferential surface of the drum and printing sheets.

An object of the present invention is to provide a stencil printing drum in which the forgoing problem can be resolved.

SUMMARY OF THE INVENTION

A stencil printing drum as defined in the first aspect of the present invention comprises a cylindrical circumferential wall including an ink permeable area and an ink impermeable area surrounding the ink permeable area, the cylindrical circumferential wall being adapted to be wrapped with a perforated stencil sheet and driven to rotate around a central axis thereof; an ink supply roller provided inside the cylindrical circumferential wall for supplying ink to an inner surface of said cylindrical circumferential wall, and pressing the ink outwardly through the ink permeable area to allow the ink to pass through a perforated area of the stencil sheet wrapped around the cylindrical circumferential wall for printing; an ink impermeable projection provided on a rear end portion of the ink permeable area relative to a rotating direction of the cylindrical circumferential wall along one of the generatrices of the cylindrical circumferential wall, the ink impermeable projection projecting inwardly of the cylindrical circumferential wall, thereby dividing the ink permeable area and the ink impermeable area; and an ink cover sheet provided on an outer surface of the cylindrical circumferential wall to cover an area ranging from the ink impermeable area to the ink impermeable projection, the ink cover sheet being fixed to the cylindrical circumferential wall at least at a rear end portion thereof in the rotating direction of the cylindrical circumferential wall; wherein the cylindrical circumferential wall has an opening after the ink impermeable projection relative to the rotating direction of the cylindrical circumferential wall, the opening being formed adjacent to the ink impermeable projection along one of the generatrices of the cylindrical circumferential wall.

A stencil printing drum as defined in the second aspect of the present invention, the ink supply roller rotates, while being in contact with the inner surface of the ink permeable area during printing, and moves to a predetermined position after crossing the ink impermeable projection, and is then separated from the inner surface, a rear end of the opening in the rotating direction of the cylindrical circumferential wall being located after the predetermined position in the rotating direction in the stencil printing drum as defined in the first aspect.

DETAILED DESCRIPTION OF PREFERRED EMBODIMENTS

Figure 1:
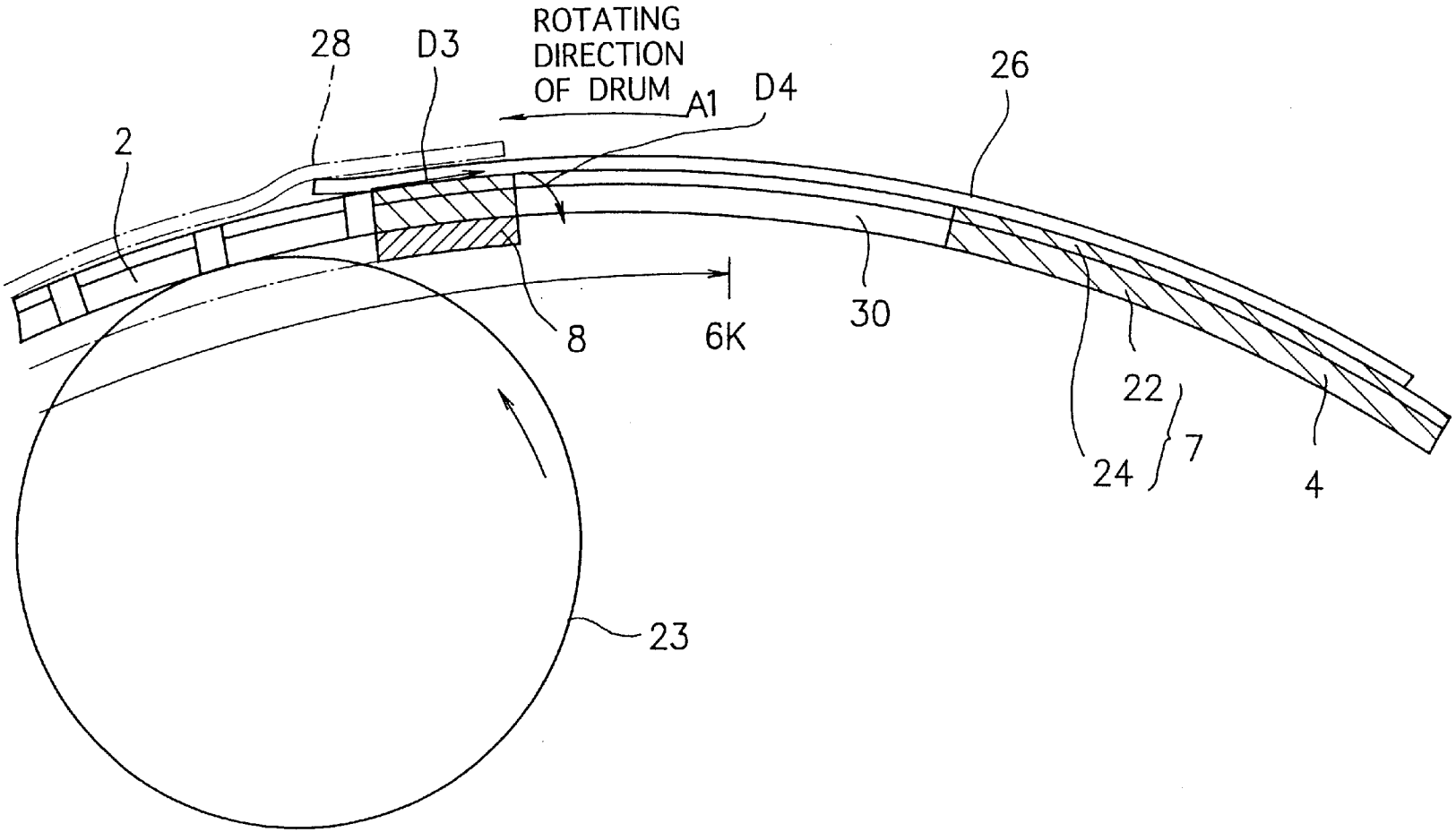
FIG. 1 is an enlarged sectional view illustrating a neighborhood of a rear end portion of a cylindrical circumferential wall 7 relative to a rotating direction thereof in one embodiment of the present invention.
Figure 2:
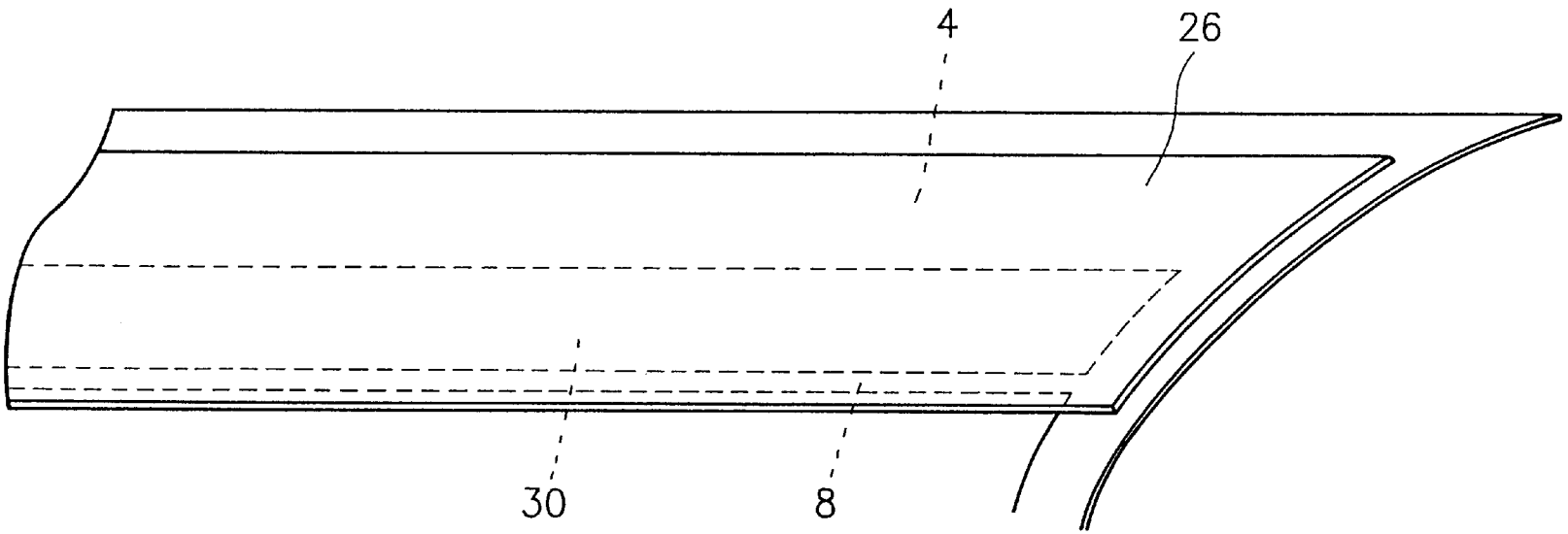
FIG. 2 is a perspective view, having an observer's view outside the cylindrical circumferential wall 7, illustrating the portion shown in FIG. 1.
Figure 3:
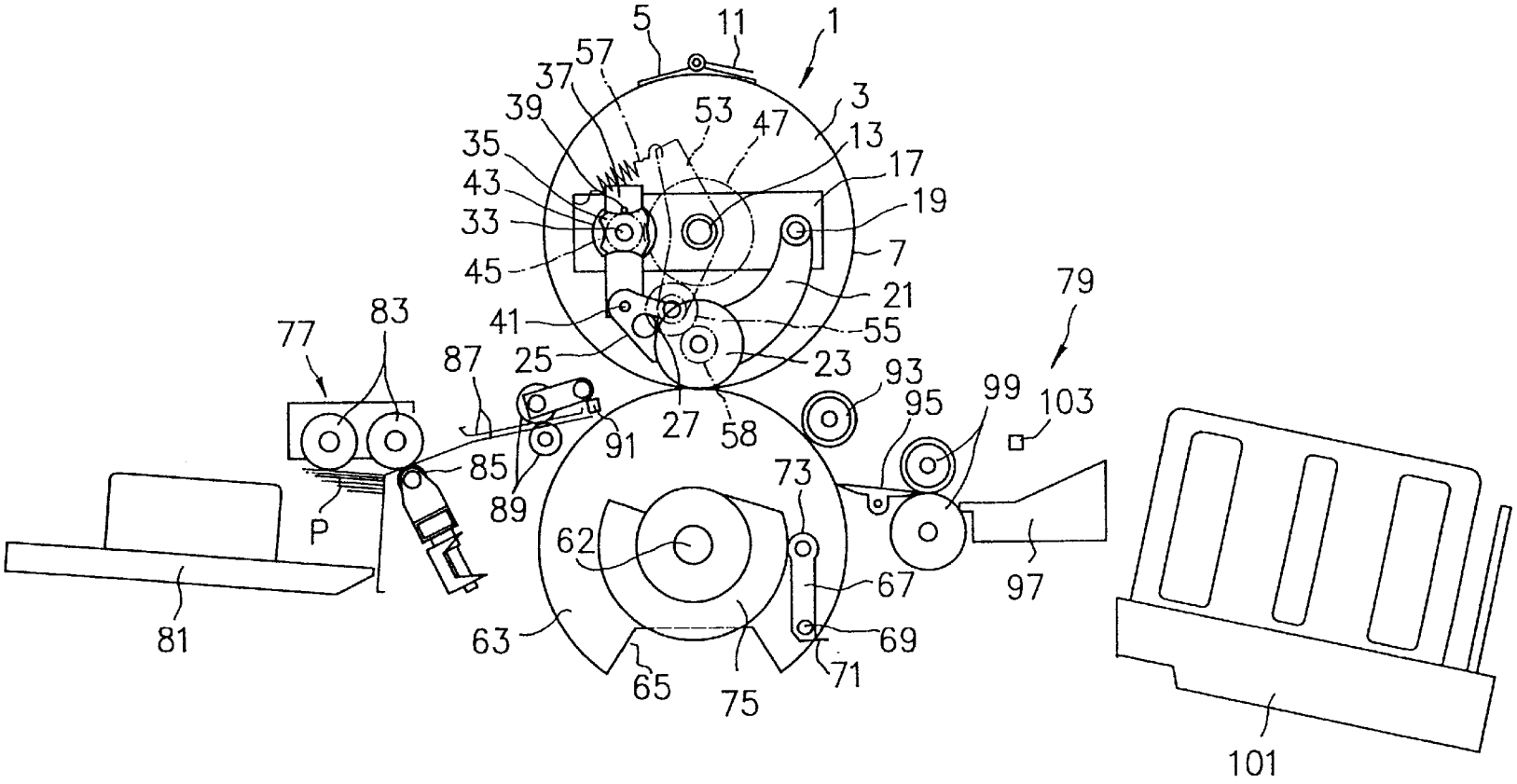
FIG. 3 is a view illustrating a printing condition in a stencil printing machine proposed by the present applicant.
Figure 4:
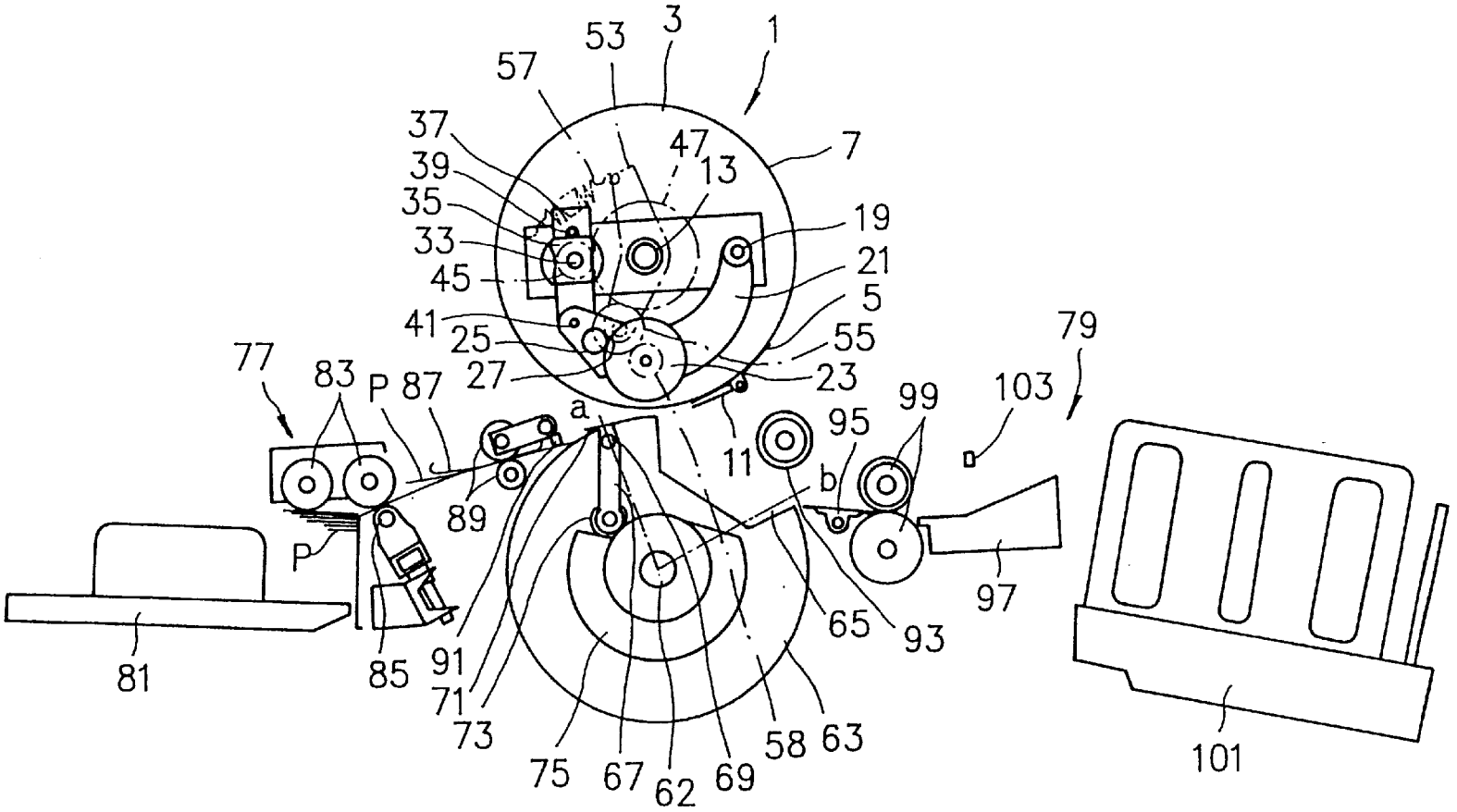
FIG. 4 is a view illustrating a non-printing condition in the stencil printing machine proposed by the present applicant.
Figure 5:
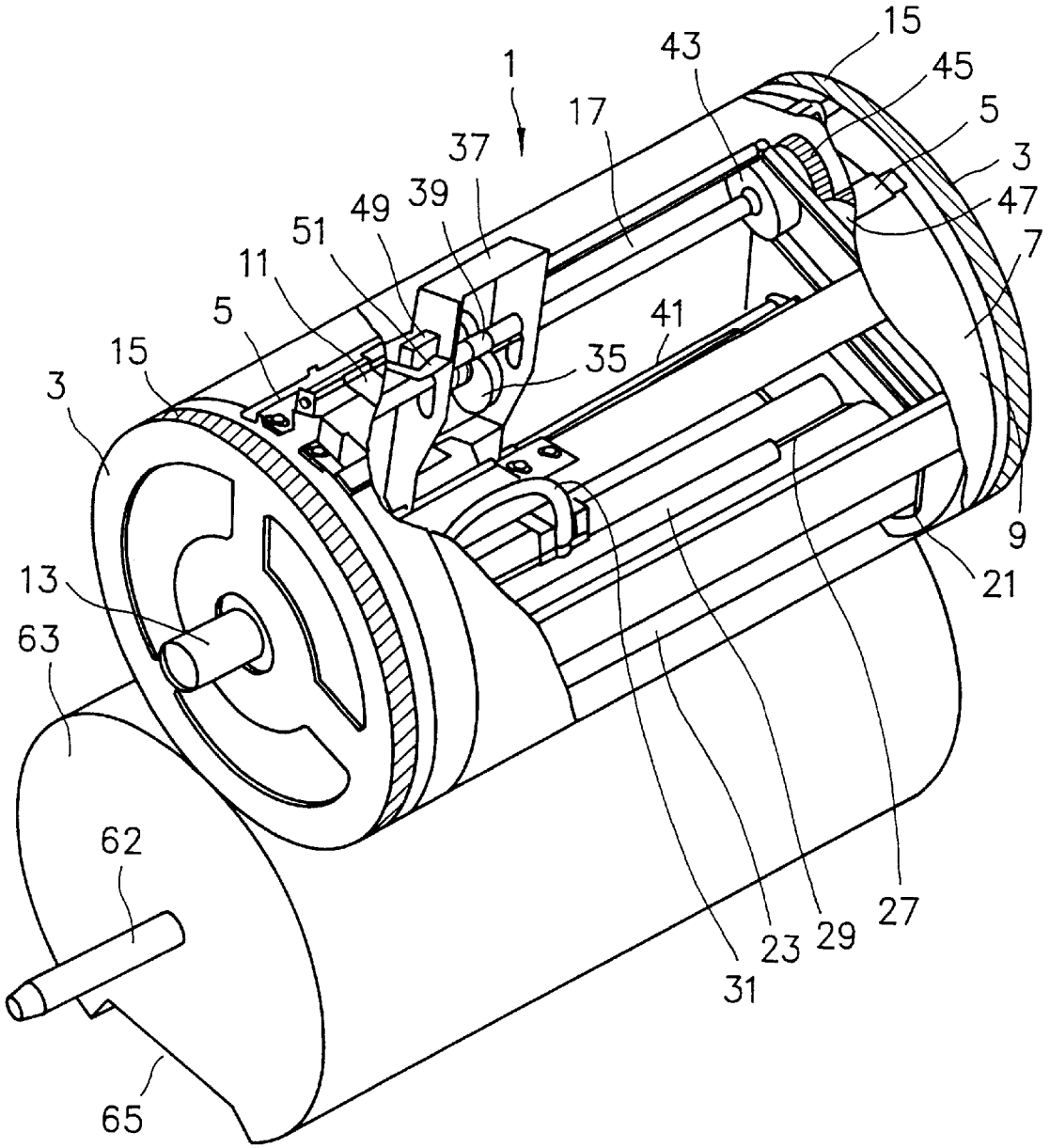
FIG. 5 is a perspective view illustrating a printing condition in a stencil printing drum of the stencil printing machine proposed by the present applicant.
Figure 6:
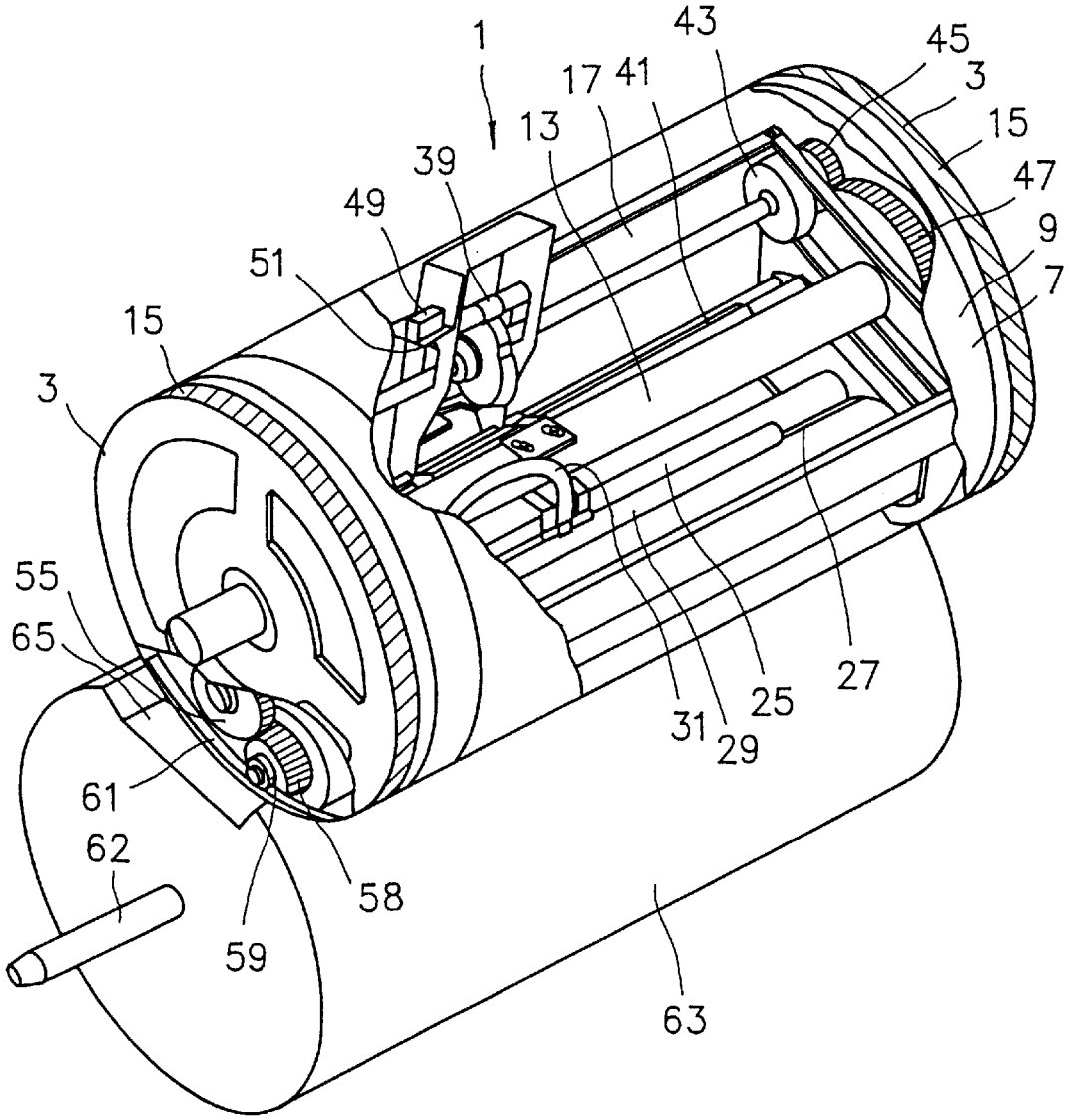
FIG. 6 is a perspective view illustrating a non-printing condition in the stencil printing drum of the stencil printing machine proposed by the present applicant.
Figure 7:
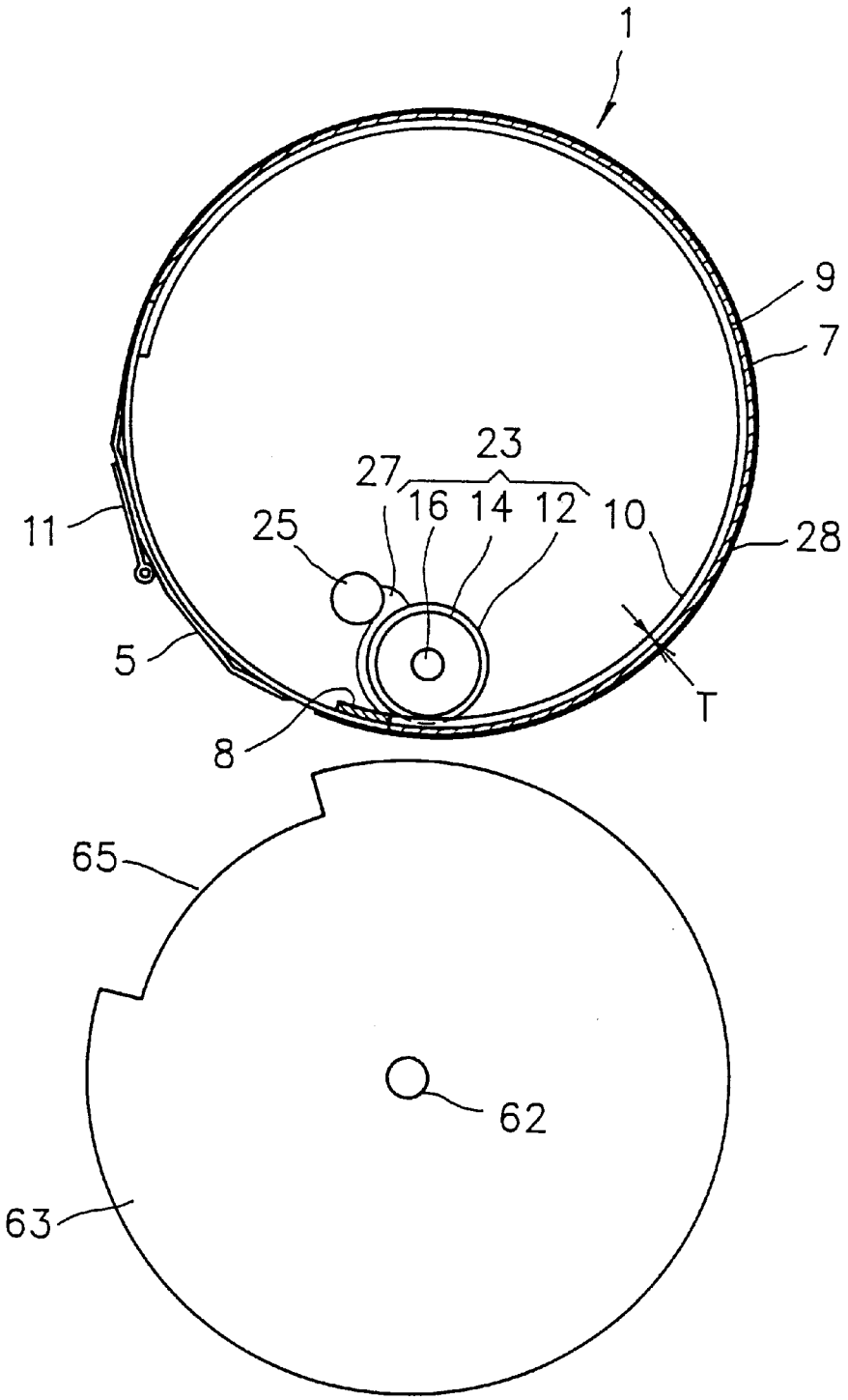
FIG. 7 is a sectional view illustrating the stencil printing drum and a back press roller of the stencil printing machine proposed by the present applicant.
Figure 8:
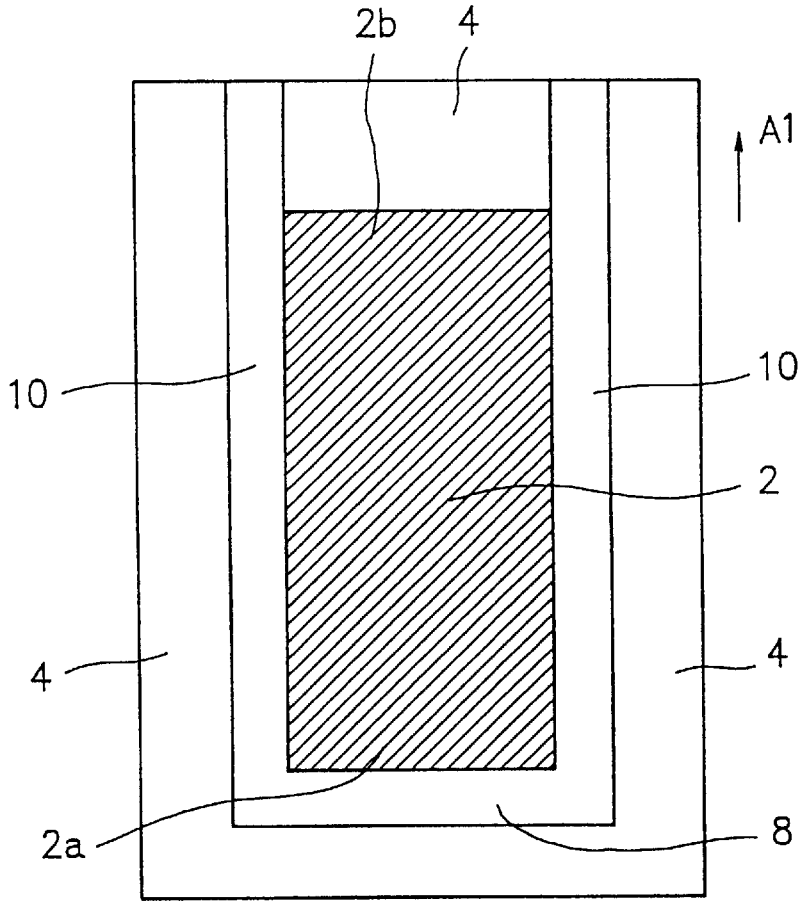
FIG. 8 is a development of the cylindrical circumferential wall of the stencil printing drum of the stencil printing machine proposed by the present applicant.
Figure 9:
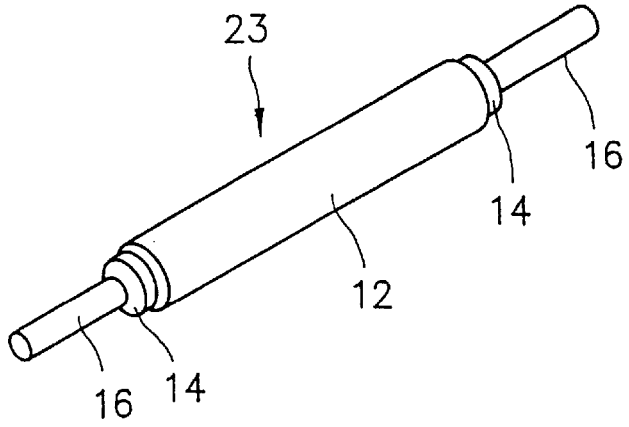
FIG. 9 is a perspective view illustrating an ink supply roller of the stencil printing drum of the stencil printing machine proposed by the present applicant.

FIG. 1 is a view illustrating a stencil printing drum in one embodiment of the present invention. An operating condition illustrated in FIG. 1 and a projection method used in drawing FIG. 1 are similar to those of FIG. 10. FIG. 2 is a perspective view illustrating the drum in FIG. 1 with an observer's view outside the drum. Composing elements in FIG. 1 that are similar to those of the drum previously explained will be indicated by the same reference numerals as those of the drum.

Figure 10:
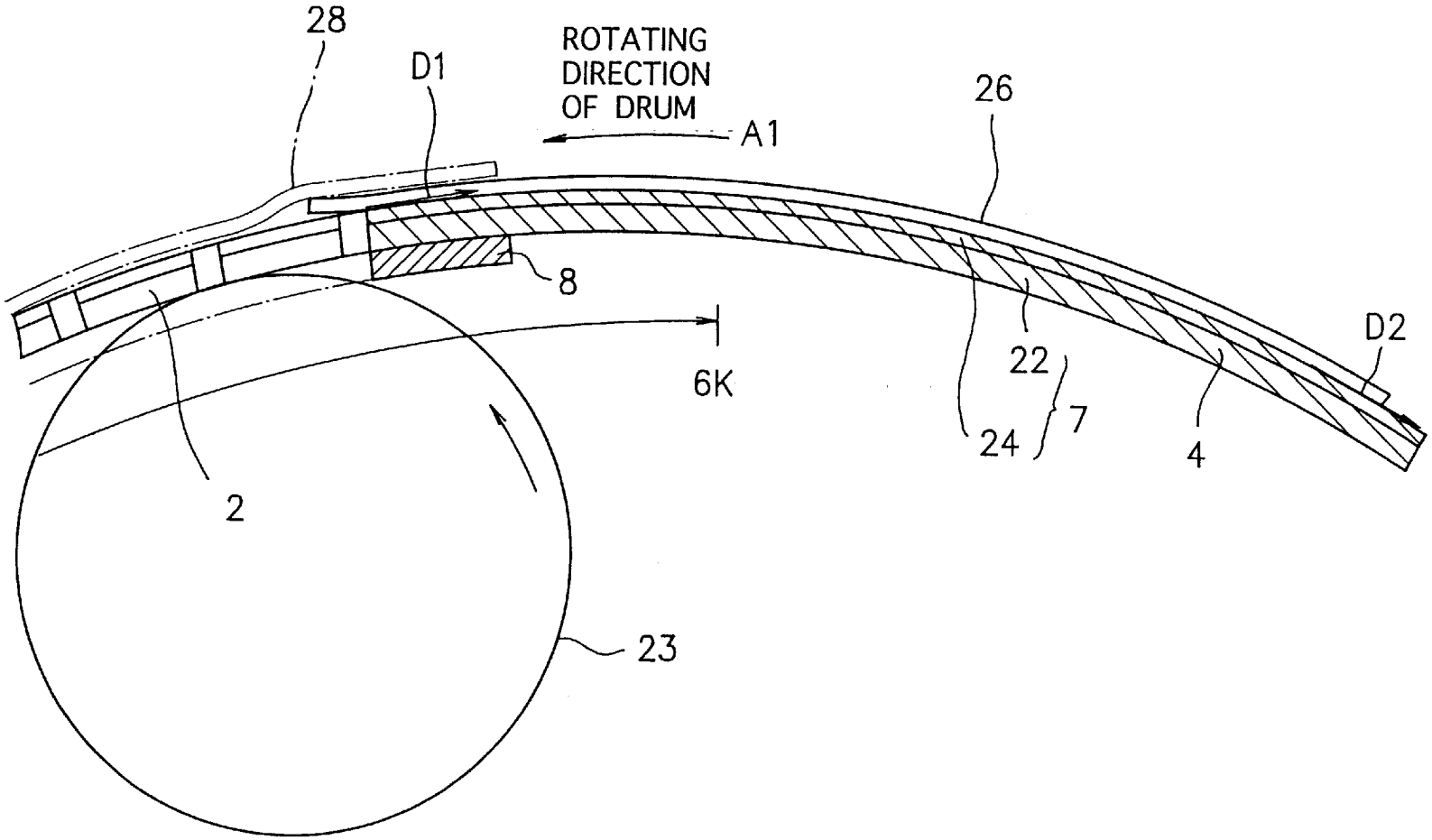
FIG. 10 is an enlarged sectional view illustrating a neighborhood of a rear end portion of a cylindrical circumferential wall 7 relative to a rotating direction thereof in a printing machine proposed by the present applicant.

A point where the drum shown in FIG. 1 is different from the drum in FIG. 10 is that an ink permeable opening 30, a non-filled area in the screens 22 and 24, is formed adjacent after the ink impermeable projection 8 relative to the rotating direction of the cylindrical circumferential wall 7 along one of the generatrices of the wall 7. The ink cover sheet 26 is fixed to the cylindrical circumferential wall at an outer circumferential portion of the ink impermeable end projection 8 and at an outer circumferential portion of the ink impermeable area 4. Conditionally, the outer circumferential portion of the ink impermeable end projection 8 is not necessarily required to be fixed to the sheet 26.

A rear end of the opening in the rotating direction of said cylindrical circumferential wall is located before the position 6K in the rotating direction. Namely, the ink supply roller 23 rotates, while being in contact with the inner surface of the ink permeable area during printing, and moves to the position 6K after crossing the ink impermeable end projection, and is then separated from the inner surface. The opening ranges from a position adjacent after the ink impermeable projection to a position after the position 6K in the rotating direction of the drum.

According to the stencil printing drum thus constituted, even in the case where the ink permeates into the clearance between the ink cover sheet 26 and the cylindrical circumferential wall 7 as shown by the arrow D3 during printing, the ink passes through the opening 30 and returns to the inside of the cylindrical circumferential wall 7 as shown by the arrow D4. Thus, the ink can not cross the opening 30, and can not enter between the ink cover sheet 26 and the ink impermeable area 4. Consequently, the ink does not spoil the outer circumferential surface of the drum 1 and printing sheets.

According to the stencil printing drum in the present invention, even in the case where the ink permeates between the ink cover sheet and the cylindrical circumferential wall, the ink passes through the opening and returns to the inside of the drum. Thus, even though a large number of sheets are printed, the ink does not spoil the outer circumferential surface of the drum 1 and printing sheets.

What is claimed is:

1. A stencil printing drum comprising:

a cylindrical circumferential wall including an ink permeable area and an ink impermeable area surrounding said ink permeable area, said cylindrical circumferential wall being adapted to be wrapped with a perforated stencil sheet and driven to rotate around a central axis thereof;

an ink supply roller provided inside said cylindrical circumferential wall for supplying ink to an inner surface of said cylindrical circumferential wall, and pressing said ink outwardly through said ink permeable area to allow the ink to pass through a perforated area of said stencil sheet wrapped around said cylindrical circumferential wall for printing;

an ink impermeable projection provided on a rear end portion of said ink permeable area relative to a rotating direction of said cylindrical circumferential wall along one of the generatrices of said cylindrical circumferential wall, said ink impermeable projection projecting inwardly of said cylindrical circumferential wall, thereby dividing said ink permeable area and said ink impermeable area; and an ink cover sheet provided on an outer surface of said cylindrical circumferential wall to cover an area ranging from said ink impermeable area to said ink impermeable projection, said ink cover sheet being fixed to the cylindrical circumferential wall at least at a rear end portion thereof in the rotating direction of said cylindrical circumferential wall;

wherein said cylindrical circumferential wall has an opening after said ink impermeable projection relative to the rotating direction of said cylindrical circumferential wall, said opening being formed adjacent to said ink impermeable projection along one of the generatrices of said cylindrical circumferential wall.

2. A stencil printing drum as claimed in claim 1, wherein said ink supply roller rotates, while being in contact with said inner surface of said ink permeable area during printing, and moves to a predetermined position after crossing said ink impermeable projection, and is then separated from said inner surface, a rear end of said opening in the rotating direction of said cylindrical circumferential wall being located after said predetermined position in the rotating direction.

* * * * *